US005263234A

United States Patent [19]

Fudaki

[11] Patent Number: 5,263,234

[45] Date of Patent: Nov. 23, 1993

[54] STRAP BUCKLE

[75] Inventor: Tsutomu Fudaki, Toyama, Japan

[73] Assignee: Yoshida Kogyo K. K., Tokyo, Japan

[21] Appl. No.: 951,759

[22] Filed: Sep. 28, 1992

[30] Foreign Application Priority Data

Sep. 30, 1991 [JP] Japan ..... 3-278719

[51] Int. Cl.[5] ..... A44B 11/26

[52] U.S. Cl. ..... 24/662; 24/615

[58] Field of Search ..... 24/615, 662, 671, 633, 24/606, 614

[56] References Cited

U.S. PATENT DOCUMENTS 2,840,878 7/1958 Olson ..... 24/615
3,251,110 5/1966 Hedu .
4,035,877 7/1977 Brownson et al. ..... 24/633 X
4,398,324 8/1983 Bakker et al. .

FOREIGN PATENT DOCUMENTS 0309943 4/1989 European Pat. Off. .
2501484 9/1982 France .

*Primary Examiner*—James R. Brittain
*Attorney, Agent, or Firm*—Hill, Steadman & Simpson

[57] ABSTRACT

A buckle comprising socket and plug bodies formed of plastics. The socket body has upper and lower plates connected with each other at their one ends. The upper plate has a circular through-hole. The lower plate has an inwardly curved locking projection extending from an annular edge portion at the side of the insertion opening and terminating in an engaging edge. The plug body has an insertion member including a resilient operating plate which extends from the side of a base end portion of the insertion member and which terminates in a downwardly directed toughing ledge resiliently touching the locking projection when the socket and plug bodies are coupled.

2 Claims, 4 Drawing Sheets

STRAP BUCKLE

BACKGROUND OF THE INVENTION

1. Field of the Invention

This invention relates to a fastener composed of male and female members to be coupled together by insertion, in which the male member can be inserted into the female member longitudinally within a generally fan-shape range and can be angularly moved within a predetermined range after the insertion, and to more particularly to a belt buckle to be used for a clothing, a suspender, a bag, a sports equipment, etc.

2. Description of the Related Art

This type of buckle is currently known (Japanese Design Registration No. 794905) which comprises a socket body having a hollow and a locking hole formed in a front surface of the socket body and communicating with the hollow, and a hook-shape plug body to be inserted into the hollow and having a locking portion to be resiliently received in the locking hole and to be locked with a forward end of the locking hole and in which the plug body can be moved freely within a predetermined angle with respect to the socket body.

With the known buckle described in the previous paragraph, partly since the buckle is made of plastics, and partly since the socket body has upper and lower plates defining therebetween a hollow into which the plug body is to be inserted has in each of opposite side walls an opening communicating with the hollow portion, the plug body can be angularly moved freely within a predetermined range when it is inserted into the socket body for coupling therewith.

However, when it is in use, this conventional type buckle would not necessarily bear only a plane load; that is, a twisting or wrenching force would act on the plug body. Since the forward end of the socket body is apt to be deformed as it is coupled with the plug body at the forward side, the upper and lower plates would be forced apart from each other so that the plug body will easily be released from the socket body.

Assuming that the plug body is twisted so as to thrust the upper plate of the socket body upwardly when the socket and plug bodies cross each other at an angle, e.g. about 120°, the plug body will be removed from the plug body with maximum ease.

SUMMARY OF THE INVENTION

It is therefore an object of this invention to provide a buckle in which the coupling of a plug body with a socket body is not accidentally released in the presence of typical loads acting on the buckle in use and in which the plug and socket bodies are locked at a base end side deep in the socket body, so that the socket body is more resistant to deformation and hence the plug body is difficult to dislodge from the socket body, thus making the buckle durable in any use.

According to this invention, there is provided a buckle comprising: a socket body made of a resilient material and having a base end portion to which one end of a belt is to be attached; and a plug body made of a resilient material and having a base end portion to which the other end of the belt is to be attached; the socket body including upper and lower plates connected with one another at one ends, the upper plate having a central circular through-hole, the lower plate having an annular edge portion and a tongue-shape locking projection which extends from the annular edge portion at a side remote of the base end portion of the socket body and which terminates in an engaging edge; the plug body including an insertion member having a resilient tongue-shape operating plate which extends from the base end portion and terminates in an annular marginal portion having on its under side an engaging ledge to be locked with the engaging edge when the plug body is inserted into the socket body.

The engaging edge may be defined by a forward semicircular part of the locking projection slightly bent upwardly, and the engaging ledge may be defined by a recess formed in the under surface of the annular marginal portion. The operating plate may have on its forward end a downwardly directed touching ledge resiliently touchable with the locking projection when the plug body is inserted into the socket body.

In use, the insertion member of the plug body is inserted into the hollow between the upper and lower plates of the socket body until the engaging ledge defined by the recess formed in the under surface of the annular marginal portion of the insertion member comes into locking engagement with the engaging edge defined by the forward part of the locking projection of the lower plate. The inserting operation has thus been completed. To remove the plug body from the socket body, the operating plate is depressed by the finger through the through-hole to bring the touching ledge of the operation plate to push the locking projection downwardly until the engaging ledge is disengaged from the engaging edge to remove the plug body from the socket body. The removing operation has thus been completed.

DETAILED DESCRIPTION

A buckle according to one embodiment of this invention will now be described with reference to the accompanying drawings.

Figure 1:
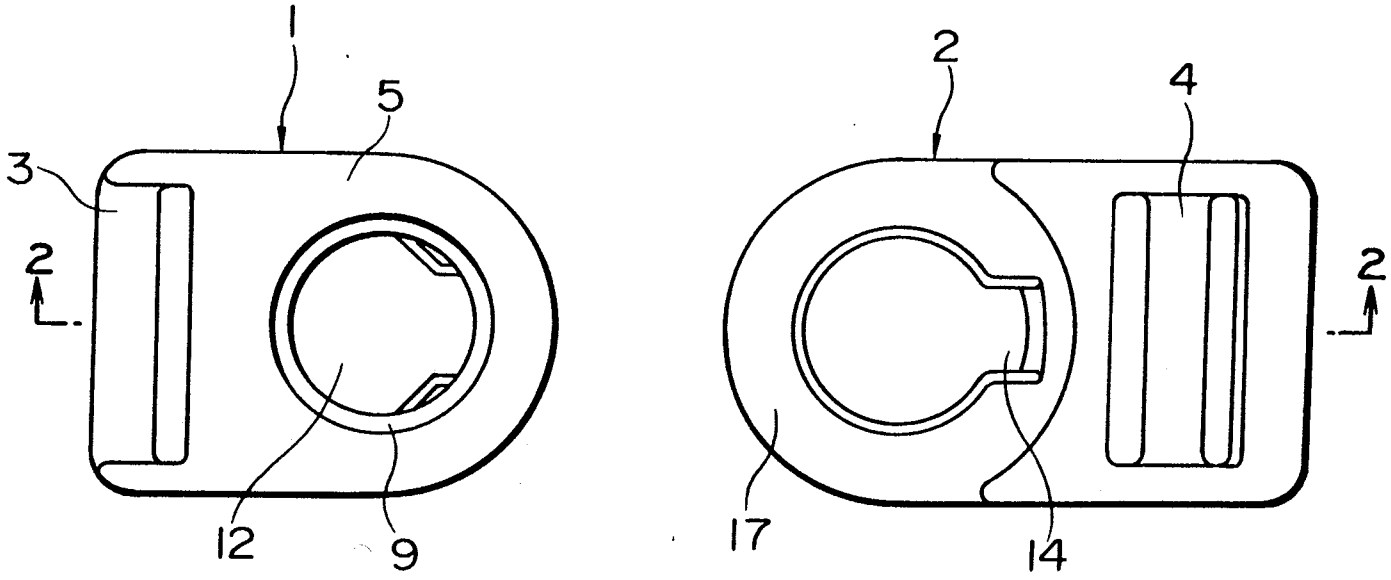
FIG. 1 is a front view of a buckle.
Figure 2:
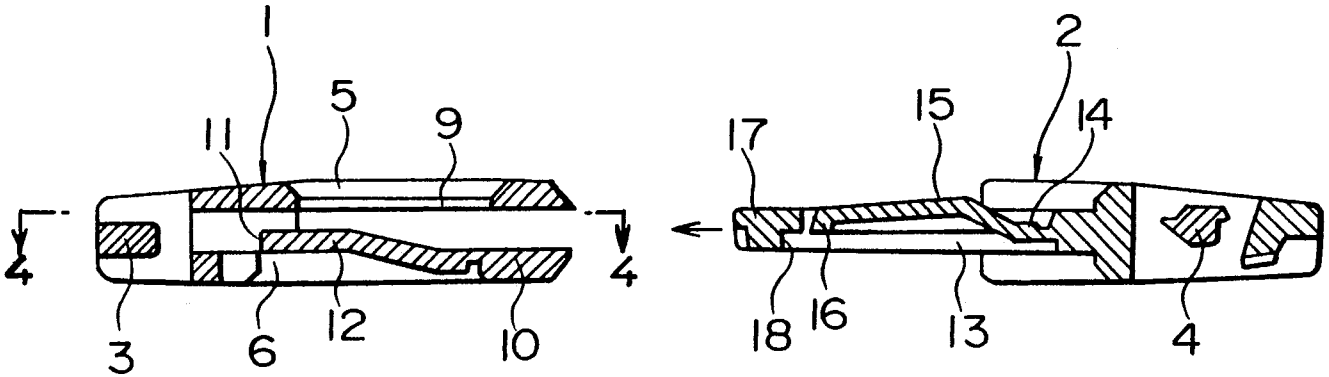
FIG. 2 is a cross-sectional view taken along line 2—2 of FIG. 1.
Figure 3:
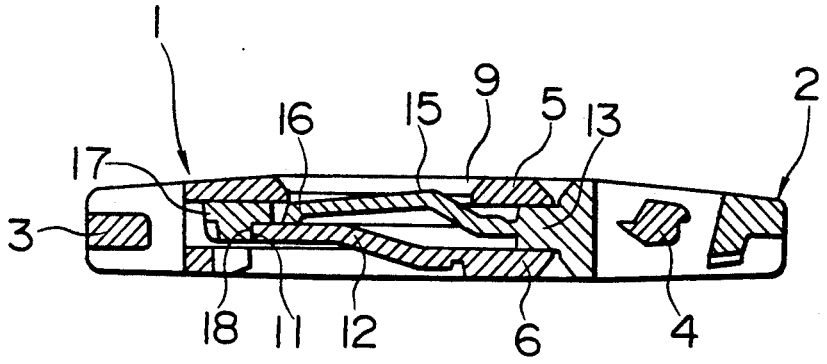
FIG. 3 is a longitudinal cross-sectional view of the buckle in a coupled posture.
Figure 4:
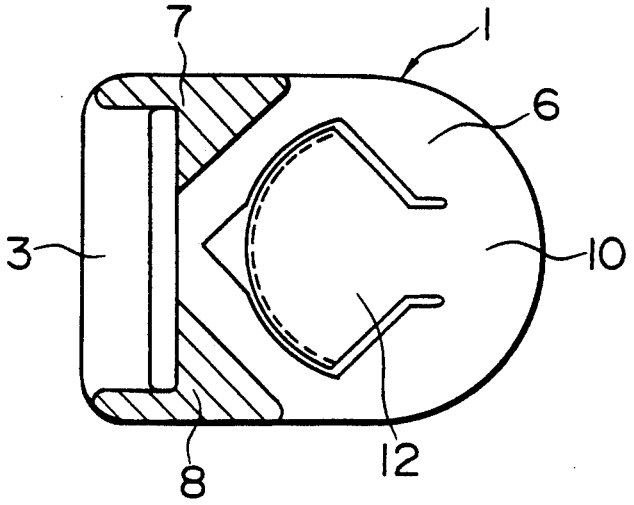
FIG. 4 is a cross-sectional view taken alone line 4—4 of FIG. 2.
Figure 5:
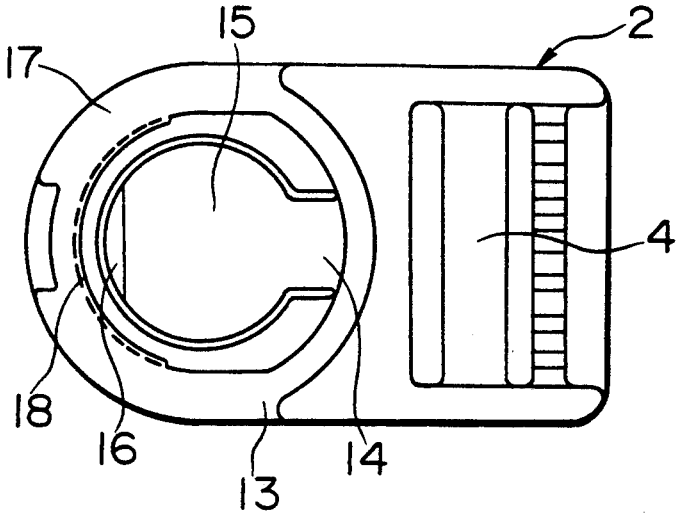
FIG. 5 is a rear view of a plug body of the buckle.

The buckle, as shown in FIGS. 1 through 5, comprises a socket body 1 and a plug body 2, which are formed of a resilient material of plastics and/or metal, each of the socket and plug bodies 1, 2 having at a base end portion a belt attachment 3, 4. The socket body 1 includes upper and lower plates 5, 6 connected at their base end portions to one another by connecting walls 7, 8, which open at their forward side portions. The upper plate 5 has a central circular through-hole 9. The lower plate 6 has an annular edge portion 10 and a C-shape locking projection 12 which extends from the annular edge portion 10 at a side remote of the base end portion of the socket body 1 and which terminates in an engaging edge 11. The locking projection 12 should by no means be limited to a C shape and may be a fan shape or any other tongue shape, with the pivotal part being connected with the annular edge portion 10. A forward semicircular part of the locking projection 12 is bent inwardly, i.e., toward the upper plate 5.

The plug body 2 includes at one side an insertion member 13 to be inserted between the upper and lower plates 5, 6 of the socket body 1. The insertion member 13 has in it a resiliently bendable tongue-shape operating plate 15 extending from a base end portion 14 and terminating in a downwardly directed touching ledge 16. The insertion member 13 has an engaging edge 18 defined by a recess formed in the under surface of an annular marginal portion 17 in such a manner that the forward upper surface of the operating plate 15 is substantially flush with the upper surface of the annular marginal portion 17. The touching ledge 16 projects from the operating plate 15 to such an extent that the under surface of the touching ledge 16 comes into slight contact with the locking projection 12 when the insertion member 13 is inserted between the upper and lower plates 5, 6 of the socket body 1, at which time the engaging edge 11 of the locking projection 12 comes into locking engagement with the engaging ledge 18 of the insertion member 13.

Having the foregoing construction, the buckle of this invention gives the following results.

Since the coupling between the socket and plug bodies is accomplished simply by bringing the engaging edge of the locking projection of the lower plate of the socket body into locking engagement with the engaging ledge of the insertion member of the plug body, the coupling operation is simple at all. Further, for releasing this coupling, when the operating plate is simply depressed by the operator's finger through the through-hole of the socket body, the touching ledge of the operating plate pushes the engaging edge of the locking projection until the engaging edge is removed from the engaging ledge of the insertion member 13, thus releasing the plug body from the socket body reliably.

More particularly, since the coupling of the engaging edge of the locking projection and the engaging ledge of the insertion member is done deeply at the side toward the base end portion of the socket body, the coupled parts deep in the socket body would hardly be deformed even if an external force is exerted on the socket body so as to make the insertion opening wider. Therefore, the coupling of the socket and plug bodies is prevented from being accidentally released, and so this buckle is suitable for use in any fastener.

What is claimed is:

1. A buckle comprising:

a socket body made of a resilient material and having a first base end portion to which one end of a belt is to be attached;

and a plug body made of a resilient material and having a second base end portion to which an opposed end of the belt is to be attached;

said socket body including upper and lower plates connected with one another at respective first ends, said upper plate having a central circular through-hole, said lower plate having an annular edge portion and a tongue-shape locking projection which extends from said annular edge portion at a side remote of said first base end portion of said socket body and which terminates in an engaging edge;

said engaging edge being defined by a forward semicircular part of said locking projection slightly bent upwardly;

said plug body including an insertion member having a resilient tongue-shape operating plate which extends from said second base end portion and terminates in an annular marginal portion having on its under side an engaging ledge to be locked with said engaging edge when said plug body is inserted into said socket body;

said engaging ledge being defined by a recess formed in the under surface of said annular marginal portion, said operating plate having on its forward end a downwardly directed touching ledge resiliently touchable with said locking projection when said plug body is inserted into said socket body.

2. A buckle comprising:

a resilient socket body with a base end portion for connection to a first strap portion;

a resilient plug body with a second base end portion for connection with a second strap portion;

said socket body having upper and lower plates and connecting portions connecting said plates to one another with a space therebetween, said upper plate having a central through-hole, and said socket body having a flexible cantilever locking projection connected to said lower plate and extending upwardly from said lower plate into the space between said upper and lower plates, and extending from its base end toward its distal end in a direction of insertion of said plug body into said socket body, said locking projection terminating in an engaging edge, said engaging edge defining a semicircle;

said plug body including an insertion member insertable between said upper and lower plates, and having an engaging ledge formed on an underside thereof, said engaging ledge having a semicircular profile compatible with said engaging edge, and upon full insertion of said insertion member into said socket body, said engaging ledge hooks said engaging edge;

said engagement ledge and said engagement edge allowing relative planar rotation between said plug body and said socket body once locked together; and wherein said insertion member further comprises a resiliently mounted operating plate arranged overlying an aperture formed through said insertion member and having a first portion contactable through said aperture with said cantilever locking projection, and a second portion arranged beneath said through-hole for pressing with a finger, pressing with a finger abuts said first portion against said cantilever locking projection and translates said locking projection toward said lower plate, disengaging said engaging edge from said engaging ledge.

* * * * *